United States Patent [19]

Terrell

[11] Patent Number: 5,029,404

[45] Date of Patent: Jul. 9, 1991

[54] PRO ATTACHABLE QUICK DRY DIFFUSER

[76] Inventor: Dorothy A. Terrell, 29 Middleton Pl., Columbus, Ga. 31907-6524

[21] Appl. No.: 398,701

[22] Filed: Oct. 13, 1989

[51] Int. Cl.[5] ..... A45D 20/00

[52] U.S. Cl. ..... 34/99

[58] Field of Search ..... 34/96, 97, 99

[56] References Cited

U.S. PATENT DOCUMENTS

| | | | |
|---|---|---|---|
| 2,453,364 | 11/1948 | Fears | 34/99 X |
| 2,632,960 | 3/1953 | Bucknell et al. | 34/99 |
| 2,820,305 | 1/1958 | Brown | 34/99 |
| 3,043,016 | 7/1962 | Miller | 34/99 |
| 3,044,183 | 7/1962 | Mauch et al. | 34/99 |

FOREIGN PATENT DOCUMENTS

| | | | |
|---|---|---|---|
| 2224361 | 5/1971 | Fed. Rep. of Germany | 34/99 |

*Primary Examiner*—Henry A. Bennet

[57] ABSTRACT

A diffuser for professional hooded dryers attaches snugly to the hooded dryers with a drawstring, opens and closes for easy access with velcro fasteners and contains eyelets that let hot air escape to prevent overheating of the hair and head. The soft, durable, heat resistant and water repellent material ensures a comfortable fit around the patron's ears and hair lines cutting the drying process tremendously and saving energy.

1 Claim, 1 Drawing Sheet

PRO ATTACHABLE QUICK DRY DIFFUSER

SUMMARY OF THE INVENTION

The Pro Attachable Quick Dry Diffuser is a device that fits around the base of beauty salons' professional hooded dryers. The diffuser, while attached to the hooded dryer, places no extra pressure on the dryer's motor, but is designed to save energy and speed hair drying. The diffuser is made of a durable soft plastic material that is heat resistanct, water repellent, and fits comfortably around the patron's ears and hair line. The diffuser attaches to hooded dryers with a drawstring and opens and closes in the front with velcro fasteners. The diffuser also contains extra large eyelets to eliminate excess hot air.

DESCRIPTION OF THE DRAWINGS

The features of my invention are illustrated in the accompanying drawings, forming part of this application, in which.

DETAILED DESCRIPTION

Figure 1:
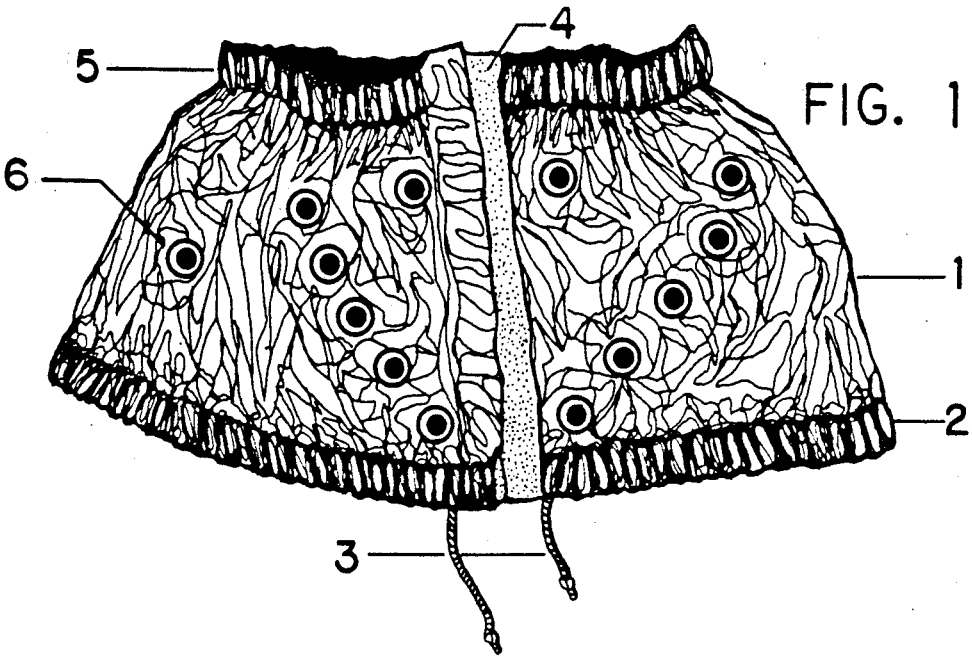
FIG. 1 is a perspective front view of the diffuser showing velcro fasteners, drawstring, eyelets, and hem containing elastic band.
Figure 2:
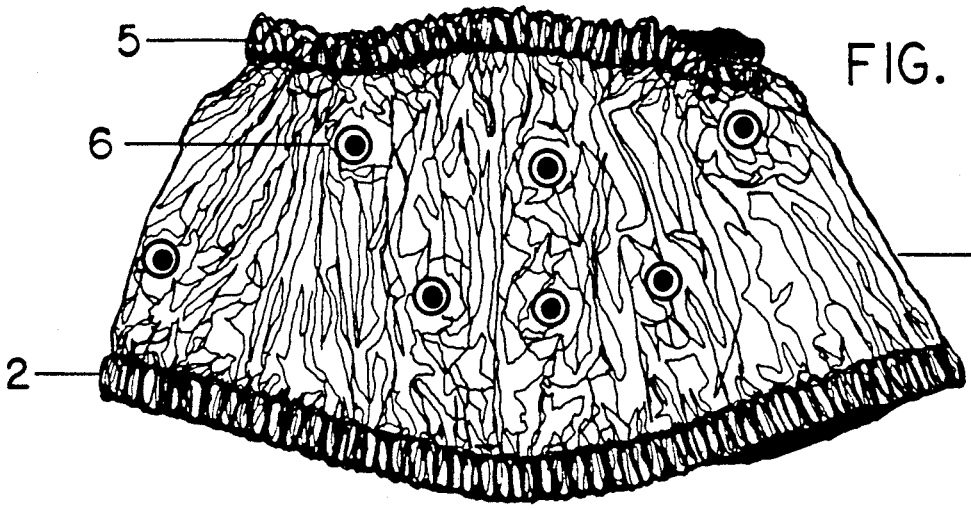
FIG. 2 is a perspective back view of the diffuser showing hem containing elastic band and eyelets.
Figure 3:
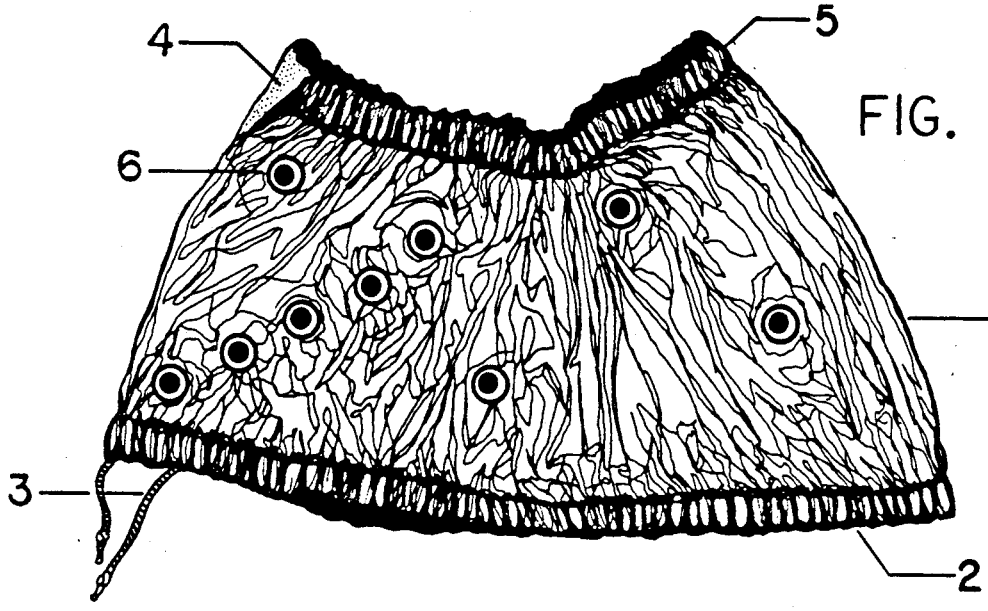
FIG. 3 is a perspective side view of the diffuser showing hem containing elastic band, eyelets, and drawstring.

Referring now to the drawing for a better understanding of my invention in FIGS. 1, 2, and 3, we see the diffuser that is made of a soft durable plastic material that is heat resistant and water repellent (1). The measurements of the diffuser are 8½ to 14 inches in length, 40 to 48 inches wide at the top, and 25 to 42 inches wide at the bottom. (2) Sewn around the inner top of the diffuser is a 1½ inch hem that contains a ⅛ to ¼ inch drawstring that secures the diffuser to the hooded dryer, shown in FIGS. 1, 2, and 3. The drawstring enters and exits (3) from the hem through two small holes, which are covered by small to medium eyelets, located 1¾ to 2½ inches from both ends, causing the device to unite, fitting tightly to the hooded dryer as shown in FIGS. 1 and 3. The string is then tied into a bow. (4) the diffuser opens and closes in the front, from top to bottom, by strips of velcro. The strips of velcro are parallel from top to bottom. There are two parallel strips on the right outer side used for adjusting the diffuser for different head sizes and one parallel strip on the left inner side used for attaching to the right side. The velcro on the right side measures in width from 2 to 2½ inches and the left side strip measures in width from 1 to 1½ inches. The velcro opening also provides the patron easy movement to and from the dryer and will not interfere with rollers that are placed in the hair as shown in FIG. 1. At the bottom of the diffuser is a 1 to 1½ hem (5) that contains a durable elastic band that enables the diffuser to fit snugly but comfortably around the patron's ears and hair line as shown in FIGS. 1, 2, and 3. The elastic band that is contained in the hem is 1 to 1½ inches wide. By fitting snugly, the diffuser is able to eliminate the flow of excess hot air to the patron's eyes and face which becomes very irritating over a period of minutes. The diffuser contours around the ears allowing them to be fully exposed so patrons are able to hold a conversation with other patrons sitting across or on either side of them. The body of the diffuser (6) contains 15–25 large to extra large eyelets (plastic or metal) to help hot air escape and prevent overheating of the hair and head. Overall the diffuser saves energy and the time a patron has to spend under a dryer. The patron's time is cut in half. The diffuser can also be attached and removed with ease to clean excess oil, makeup, etc., that would otherwise cause sanitary problems.

What I claim is:

1. A device that attaches to the base of professional hooded dryers comprising a diffuser means comfortable to the human head of:

a. a durable soft plastic material wherein said material is heat resistant and water repellent;

b. a drawstring that extends around said diffuser causing said diffuser to fit tightly to hooded dryer;

c. fasteners on the front right inner side used for adjusting said diffuser to allow easy access to and from the dryer without assistance from salon operators;

d. fasteners on the front left inner side used for connecting to the right side;

e. means to eliminate excess hot air from said diffuser with extra large eyelets to prevent overheating of the hair and head; and f. an elastic band that is contained in the bottom of hem of said diffuser enabling it to fit snugly but comfortably around patron's ears and hair line leaving the patron's ears exposed.

* * * * *